US011434862B2

(12) United States Patent
Tanaya

(10) Patent No.: US 11,434,862 B2
(45) Date of Patent: Sep. 6, 2022

(54) INTERNAL-COMBUSTION-ENGINE CONTROLLER

(71) Applicant: Mitsubishi Electric Corporation, Tokyo (JP)

(72) Inventor: Kimihiko Tanaya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/399,601

(22) Filed: Aug. 11, 2021

(65) Prior Publication Data

US 2022/0145844 A1 May 12, 2022

(30) Foreign Application Priority Data

Nov. 9, 2020 (JP) ..... JP2020-186286

(51) Int. Cl.

| | |
|---|---|
| ***F02D 41/22*** | (2006.01) |
| ***F02P 11/06*** | (2006.01) |
| ***F02D 41/40*** | (2006.01) |
| ***F02B 19/12*** | (2006.01) |
| ***F02P 3/02*** | (2006.01) |
| ***F02P 9/00*** | (2006.01) |
| *F02D 41/38* | (2006.01) |

(52) U.S. Cl.

CPC ..... *F02P 11/06* (2013.01); *F02B 19/12* (2013.01); *F02D 41/22* (2013.01); *F02D 41/401* (2013.01); *F02P 3/02* (2013.01); *F02P 9/00* (2013.01); *F02D 2041/389* (2013.01)

(58) Field of Classification Search

CPC ..... F02P 11/06; F02P 3/02; F02P 9/00; F02B 19/12; F02D 41/22; F02D 41/401; F02D 2041/389

USPC ..... 123/260, 261, 275, 286, 406.13, 435

See application file for complete search history.

(56) References Cited

U.S. PATENT DOCUMENTS

2009/0043479 A1 2/2009 Noda et al.
2021/0156325 A1* 5/2021 Glugla ..... F02D 9/02

FOREIGN PATENT DOCUMENTS

JP 2003-286891 A 10/2003
JP 2003-286892 A 10/2003

(Continued)

OTHER PUBLICATIONS

Office Action dated Feb. 1, 2022 in Japanese Application No. 2020-186286 English Translation.

*Primary Examiner* — Hai H Huynh

(74) *Attorney, Agent, or Firm* — Sughrue Mion, PLLC; Richard C. Turner

(57) ABSTRACT

The objective is to provide an internal-combustion-engine controller that can diagnose a smolder state in a subsidiary combustion chamber of a subsidiary-chamber-type internal combustion engine at low cost and in real time and that can perform control so as to securely produce a spark discharge. The controller controls an internal combustion engine in which a fuel-air mixture in the main combustion chamber is ignited with combustion gas to be injected through an orifice provided in a subsidiary combustion chamber; the controller includes an ignition plug and a detection probe arranged in the subsidiary combustion chamber, an ignition coil, a fuel injector, a smolder detector, and a smolder diagnosis device, and controls at least one of the ignition coil and the fuel injector in accordance with a diagnostic result in the smolder diagnosis device.

15 Claims, 7 Drawing Sheets

(56) References Cited

FOREIGN PATENT DOCUMENTS

| | | | |
|---|---|---|---|
| JP | 2009-057958 | A | 3/2009 |
| JP | 2013-177946 | A | 9/2013 |
| JP | 2017-103179 | A | 6/2017 |

* cited by examiner

INTERNAL-COMBUSTION-ENGINE CONTROLLER

BACKGROUND OF THE INVENTION

Field of the Invention

The present disclosure relates to an internal-combustion-engine controller.

Description of the Related Art

As countermeasures for global warming that has been problematized in recent years, world-wide approach to reduce greenhouse effect gas has started. Because this approach is required also in the automobile industry, development for improving the efficiency of an internal combustion engine is being promoted.

Among internal combustion engines, there exists an internal combustion engine provided with a subsidiary combustion chamber having an orifice at the front end of an ignition plug. A fuel-air mixture is ignited in the subsidiary combustion chamber and then combustion gas is injected through the orifice into a main combustion chamber. The internal combustion engine in which a fuel-air mixture in the main combustion chamber is ignited with the injected combustion gas is referred to as a subsidiary-chamber-type internal combustion engine (for example, Patent Document 1). Because in this method, multi-point ignition can rapidly be applied to the fuel-air mixture in the main combustion chamber, the combustion period can be shortened even with a lean fuel-air mixture; thus, stable operation can be performed. Accordingly, because the thermal efficiency can largely be raised, the method has been drawing attention, as a method in which the exhaust amount of greenhouse effect gas can largely be reduced.

PRIOR ART REFERENCE

Patent Literature

[Patent Document 1] Japanese Patent Application Laid-Open No. 2017-103179

SUMMARY OF THE INVENTION

In a subsidiary-chamber-type internal combustion engine, because the subsidiary combustion chamber is connected with the main combustion chamber though an orifice, there exists a problem in terms of the scavenging performance. Accordingly, when the load is small, burned gas produced by combustion is liable to stagnate in the subsidiary combustion chamber. In the case of combustion in a cold machine in which its internal combustion engine is cold, unburned fuel or the like is liable to produce soot. Accordingly, there may be caused a smolder state in which soot deposited on an ignition plug in the subsidiary combustion chamber weakens the insulation state between the electrodes of the ignition plug. It poses a problem that when the deposit of soot develops, a misfire is caused. When a misfire is caused, unburned gas is discharged into the air, which causes environmental pollution. In addition, when unburned gas combusts in an exhaust pipe, beside a catalyst, or in a muffler, an exhaust-gas sensor and the catalyst may be caused to be deteriorated or to fail.

In order to solve the foregoing problems, for example, as disclosed in Patent Document 1, the respective shapes of the ignition-plug electrode portions, the inside of the subsidiary combustion chamber, the orifice, and the like and the positional relationship thereamong are being contrived and accurate arrangement thereof is being studied. However, there changes the environment around the ignition plug and the subsidiary combustion chamber, such as various shapes of internal combustion engines, wide-range operation conditions, carbon adhesion to and carbon deposits on the electrodes of the ignition plug, deterioration and consumption of the electrodes, and the like. Accordingly, it is difficult to cope with the problems only by depending on the mechanical structure. It is required to adequately control the internal combustion engine in accordance with the inside state of the subsidiary combustion chamber thereof. However, there has been no method that can diagnose a smolder state in the subsidiary combustion chamber at low cost and in real time.

The objective of the present disclosure is to provide an internal-combustion-engine controller that can diagnose a smolder state in a subsidiary combustion chamber of a subsidiary-chamber-type internal combustion engine at low cost and in real time and that can deal therewith so as to securely produce a spark discharge.

An internal-combustion-engine controller according to the present disclosure is provided with a main combustion chamber and a subsidiary combustion chamber for igniting a fuel-air mixture in the main combustion chamber with combustion gas to be injected through an orifice provided between the main combustion chamber and itself and that controls an internal combustion engine; the internal-combustion-engine controller includes a fuel injector that injects a fuel into the main combustion chamber, an ignition plug that is disposed in the subsidiary combustion chamber and generates a spark discharge between an electrode to which a high voltage is applied and a reference electrode so as to combust a fuel-air mixture, an ignition coil that supplies a high voltage to the ignition plug, a control device that controls the fuel injector and the ignition coil, a detection probe that is disposed in the subsidiary combustion chamber, a smolder detector that detects a smolder state caused by soot deposited on the ignition plug by use of the detection probe, and a smolder diagnosis device that diagnoses a smolder state in the subsidiary combustion chamber in accordance with a smolder detection signal from the smolder detector; the internal-combustion-engine controller is characterized in that in accordance with a diagnostic result in the smolder diagnosis device, the control device controls operation of at least one of the ignition coil and the fuel injector.

An internal-combustion-engine controller according to the present disclosure can diagnose a smolder state in a subsidiary combustion chamber of a subsidiary-chamber-type internal combustion engine at low cost and in real time and that can appropriately deal therewith so as to securely produce a spark discharge; therefore, because the subsidiary-chamber-type internal combustion engine can stably be operated, the thermal efficiency can largely be raised and the reliability can also be enhanced.

The foregoing and other object, features, aspects, and advantages of the present invention will become more apparent from the following detailed description of the present invention when taken in conjunction with the accompanying drawings.

DETAILED DESCRIPTION OF THE PREFERRED EMBODIMENTS

Hereinafter, a controller 1 of an internal combustion engine 100 according to the present disclosure will be explained with reference to the drawings.

1. Embodiment 1

<First Configuration of Internal Combustion Engine>

Figure 1:
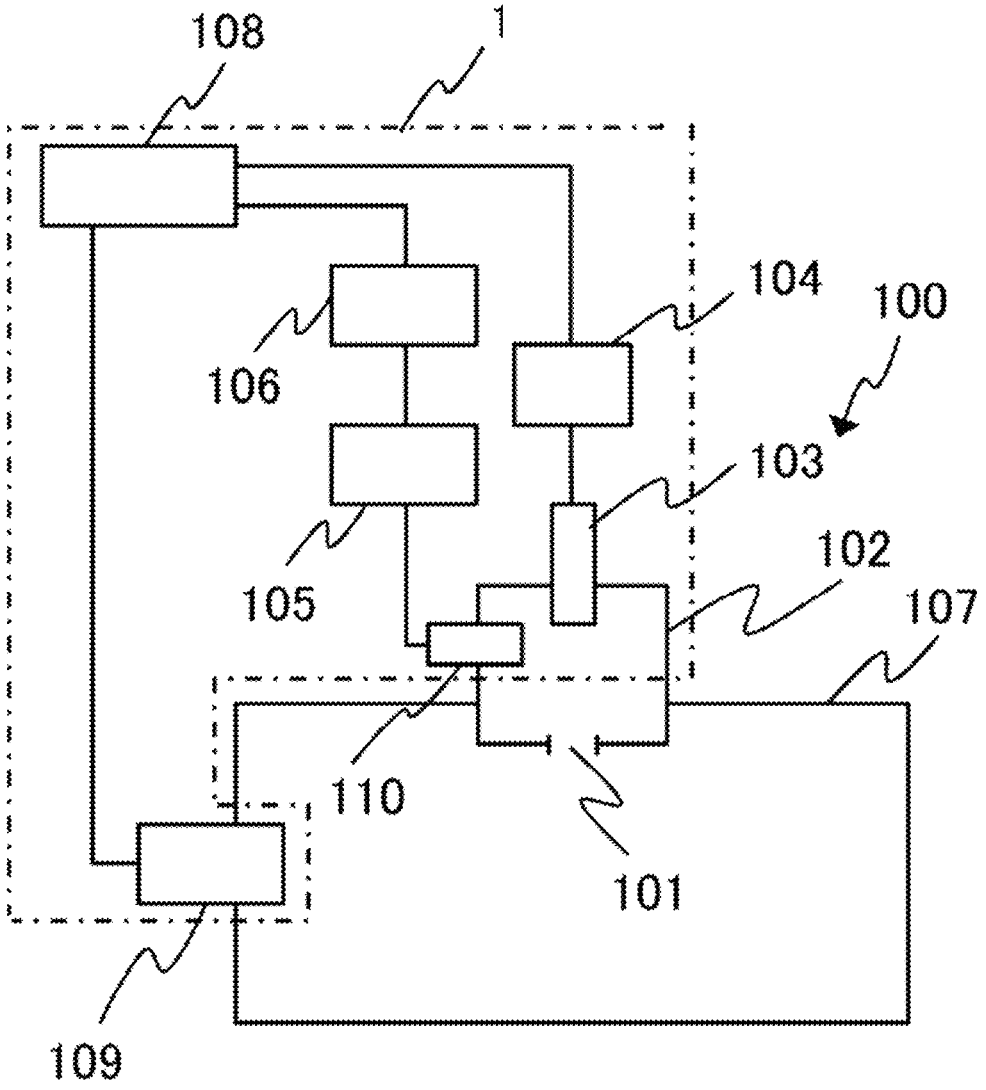
FIG. 1 is a first configuration diagram of an internal combustion engine according to Embodiment 1.

FIG. 1 is a first configuration diagram of the internal combustion engine 100 according to Embodiment 1 and is a simplified conceptual diagram. The internal combustion engine 100 has a main combustion chamber 107, a subsidiary combustion chamber 102, and an orifice 101 that makes the main combustion chamber 103 and the subsidiary combustion chamber 102 communicate with each other. A controller 1 of the internal combustion engine 100 (hereinafter, referred to simply as a controller 1) has a control device 108, a fuel injector 109, an ignition coil 104, an ignition plug 103, a smolder diagnosis device 106, a smolder detector 105, and a detection probe 110.

The ignition plug 103 is disposed in the subsidiary combustion chamber 102. The ignition plug 103 has a central electrode to which a high voltage is transferred, and forms a spark discharge between the central electrode and a GND electrode (referred to also as a reference electrode) in response to application of the high voltage. The ignition plug 103 is connected with the ignition coil 104 for supplying a high voltage. The fuel injector 109 for injecting a fuel is provided in the main combustion chamber.

The control device 108 controls the ignition coil 104 and the fuel injector 109. The control device 108 controls energization and cutoff timings for the ignition coil so as to control the timing of a spark discharge to be produced in the ignition plug 103 inside the subsidiary combustion chamber and the amount of energy to be discharged. The control device 108 controls the fuel injector 109 so as to control the fuel supply amount for the main combustion chamber and the fuel supply timing.

The main combustion chamber 107 has an intake port communicating with an intake pipe, an exhaust port communicating with an exhaust pipe, and a movable piston that is connected with a rod coupled with a crankshaft and produces an output; however, in FIG. 1, the descriptions therefor are omitted. A fuel-air mixture obtained by mixing a fuel, injected from the fuel injector 109 disposed in the main combustion chamber 107, with air is supplied to the subsidiary combustion chamber 102. The fuel-air mixture in the subsidiary combustion chamber is ignited by a spark discharge in the ignition plug. A flame grows in the subsidiary combustion chamber 102; then, the pressure in the subsidiary combustion chamber rises. After that, high-temperature combustion gas is blown into the main combustion chamber through the orifice, so that the fuel-air mixture in the main combustion chamber is ignited. Accordingly, ignition of the fuel-air mixture in the main combustion chamber is facilitated and hence it is made possible that a lean fuel-air mixture stably combusts. The controller 1 can contribute to improvement of the thermal efficiency of the internal combustion engine 100 by expanding a lean-fuel area.

The detection probe 110 is also disposed in the subsidiary combustion chamber 102. The smolder detector 105 detects a smolder state in the subsidiary combustion chamber 102 through the detection probe 110 and then outputs a smolder detection signal corresponding to the smolder state. The smolder diagnosis device 106 diagnoses a smolder state in the subsidiary combustion chamber in accordance with the smolder detection signal.

The diagnostic result obtained by the smolder diagnosis device 106 is inputted to the control device 108. In accordance with the diagnostic result obtained by the smolder diagnosis device 106, the control device 108 controls the internal combustion engine so that a spark discharge can securely be produced. The control device 103 manipulates at least one of the ignition coil 104 and the fuel injector 109 so that the internal combustion engine 100 can stably continue its operation.

The number of the orifices 101 that are provided in the subsidiary combustion chamber 102 so as to inject combustion gas into the main combustion chamber 107 may be plural; in many cases, the orifices 101 are provided at three to eight positions. Among subsidiary-chamber-type internal combustion engines, there exists a so-called active-type one in which a fuel injector is disposed in the subsidiary combustion chamber 102 so that a fuel is directly injected into the subsidiary combustion chamber. In addition, there exists a so-called passive-type one in which a fuel injector is not disposed in the subsidiary combustion chamber 102 and in which a fuel injected into the main combustion chamber 107 is introduced along with air into the subsidiary combustion chamber by means of a pressure difference between the main combustion chamber 107 and the subsidiary combustion chamber 102. The present disclosure can be applied to the both types. Moreover, there exists a type in which an ignition plug is disposed not only in the subsidiary combustion chamber 102 but also in the main combustion chamber 107; in the present disclosure, it may be allowed that an ignition plug is disposed in the main combustion chamber 107. Moreover, FIG. 1 represents an example in which the fuel injector 109 is disposed in the main combustion chamber; however, it may be allowed that the fuel injector 109 is provided in an intake pipe or in an intake port.

<Hardware Configuration of Control Device>

Figure 2:
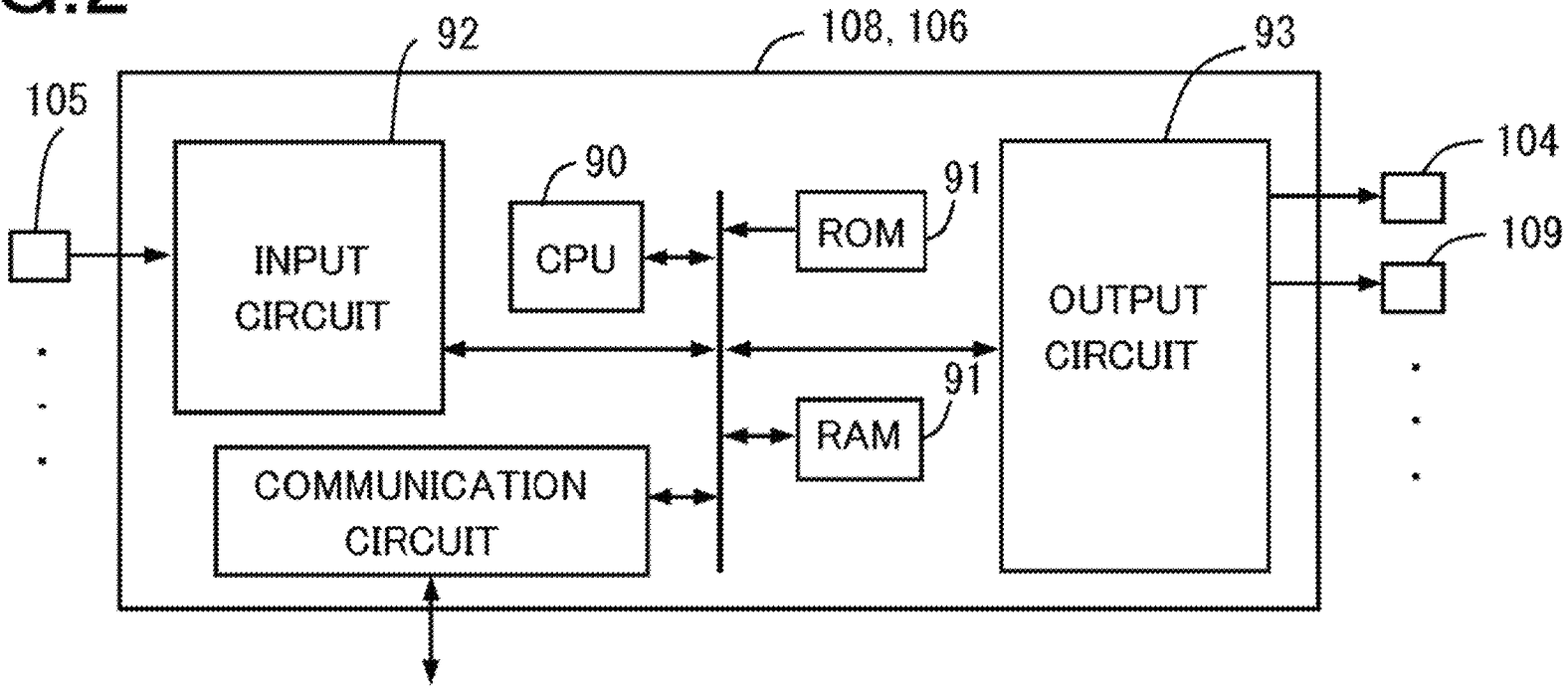
FIG. 2 is a hardware configuration diagram of a control device according to Embodiment.

FIG. 2 is a hardware configuration diagram of the control device 108. The hardware configuration in FIG. 2 can be applied to the control device 108 and the smolder diagnosis device 106; however, in the following explanation, the control device 108 will be explained as a representative. In the present embodiment, the control device 108 is a control device for controlling the internal combustion engine 100. Respective functions of the control device 108 are realized by processing circuits provided therein. Specifically, the control device 108 includes, as the processing circuits, a computing processing unit (computer) 90 such as a CPU (Central Processing Unit), storage apparatuses 91 that exchange data with the computing processing unit 90, an input circuit 92 that inputs external signals to the computing processing unit 90, an output circuit 93 that outputs signals from the computing processing unit 90 to the outside, and the like.

It may be allowed that as the computing processing unit 90, an ASIC (Application Specific Integrated Circuit), an IC (Integrated Circuit), a DSP (Digital Signal Processor), an FPGA (Field Programmable Gate Array), each of various kinds of logic circuits, each of various kinds of signal processing circuits, or the like is provided. In addition, it may be allowed that as the computing processing unit 90, two or more computing processing units of the same type or different types are provided and respective processing items are executed in a sharing manner. As the storage apparatuses 91, there are provided a RAM (Random Access Memory) that can read data from and write data in the computing processing unit 90, a ROM (Read Only Memory) that can read data from the computing processing unit 90, and the like. The input circuit 92 is connected with various kinds of sensors including the output signal of the smolder diagnosis device 106, switches, and communication lines, and is provided with an A/D converter, a communication circuit, and the like for inputting output signals from these sensors and switches and communication information to the computing processing unit 90. The output circuit 93 is provided with a driving circuit and the like for outputting control signals from the computing processing unit 90 to driving apparatuses including the fuel injector 109 and the ignition coil 104.

The computing processing unit 90 runs software items (programs) stored in the storage apparatus 91 such as a POM and collaborates with other hardware devices in the control device 108, such as the storage apparatus 91, the input circuit 92, and the output circuit 93, so that the respective functions provided in the control device 108 are realized. Setting data items such as a threshold value and a determination value to be utilized in the control device 108 are stored, as part of software items (programs), in the storage apparatus 91 such as a ROM. It may be allowed that the respective functions included in the control device 108 are configured with either software modules or combinations of software and hardware.

Heretofore, the control device 108 has been described; however, the above explanation can be applied also to the smolder diagnosis device 106. The smolder diagnosis device 106 receives the smolder detection signal from the smolder detector 105, processes input information by the computing processing unit 90, and then outputs a diagnostic result to the control device 108.

<Smolder>

In the internal combustion engine 100, a smolder signifies the state where soot is deposited on an ignition plug and hence the insulation state between the electrodes of the ignition plug is weakened. The deposited sort will be referred to as carbon deposits. Carbon (soot) produced by incomplete combustion at a time when the air-fuel ratio in the vicinity of an ignition plug is rich and the temperature of the ignition plug is low is deposited on the ignition plug; as a result, carbon deposits are produced.

When carbon deposits on the ignition plug develop, the insulating resistance value between the central electrode and the GND electrode of the ignition plug drastically decreases. Accordingly, energy for a spark discharge leaks and hence no spark discharge is produced or a sufficient spark discharge is not formed; thus, a misfire occurs.

When a misfire frequently occurs, an unburned fuel-air mixture is discharged to the exhaust system and combusts in the exhaust pipe; thus, the temperature of the exhaust system rises. As a result, the exhaust-gas sensor and a catalyst may be deteriorated; or, what is worse, the catalyst may be dissolved.

<Second Configuration of Internal Combustion Engine>

The second configuration of the internal combustion engine 100 and the specific operation of a smolder diagnosis will be explained by use of FIGS. 3, 4, 5, and 6.

Figure 3:
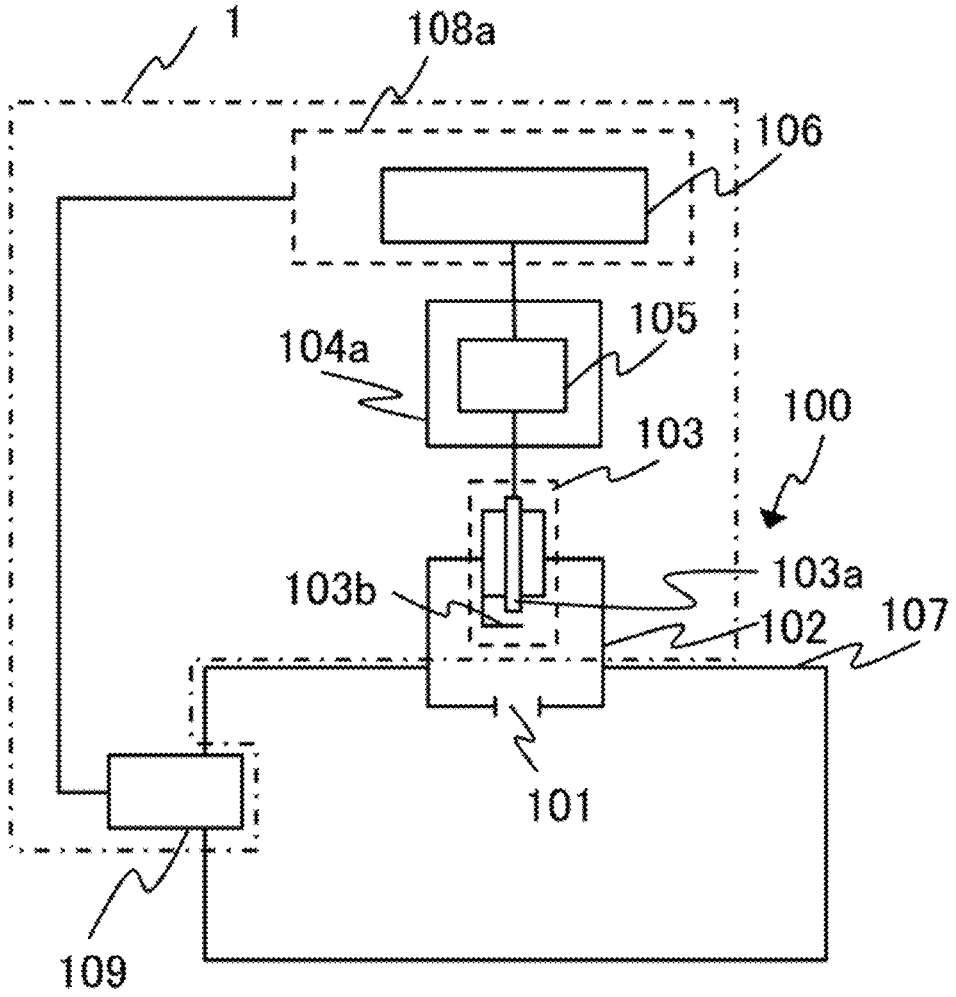
FIG. 3 is a second configuration diagram of the internal combustion engine according to Embodiment 1.

FIG. 3 is a second configuration diagram of the internal combustion engine 100 according to Embodiment 1. FIG. 3 is different from FIG. 1 in that the detection probe 110 for detecting a smolder is included in the ignition plug 103. In addition, the smolder detector 105 is incorporated in an ignition coil 104*a*, and the smolder diagnosis device 106 is incorporated in a control device 108*a*. The configuration as described above makes it possible to realize the controller 1 that has a very small-size, low-cost, and simple configuration and has a smolder detection function. However, such integration of components is not essential problem in each of the smolder detection and the diagnosis of the present disclosure; thus, it may be allowed that the smolder diagnosis device 106 and the control device 108*a* are separated from each other, that the ignition coil 104*a* and the smolder detector 105 are separated from each other, and that the detection probe 110 and the ignition plug 103 are separated from each other. That is to say, it is made possible that the following smolder diagnosis is performed while the configuration in FIG. 1 is maintained.

In FIG. 3, a spark discharge for igniting a fuel in the subsidiary combustion chamber 102 is formed between the central electrode 103*a* and the GND electrode 103*b* (reference electrode) of the ignition plug 103. The control device 108*a* issues an instruction to the ignition coil 104*a*. In this situation, the hardware configuration represented in FIG. 2 is applied to the control device 108*a*.

Figure 6:
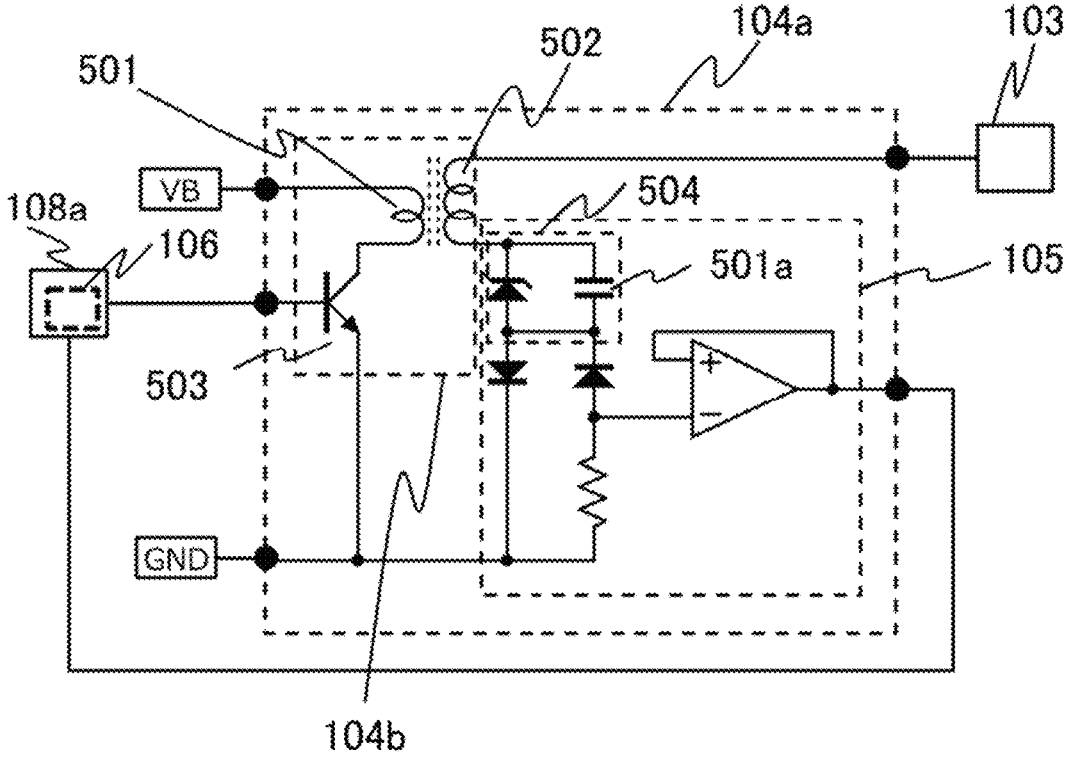
FIG. 6 is a circuit diagram of a smolder detector according to Embodiment 1.

The basic function of the ignition coil 104*a* is generally represented in an ignition-coil basic function unit 104*b* in FIG. 6. FIG. 6 is a circuit diagram of the smolder detector 105 according to Embodiment 1. The ignition-coil basic function unit 104*b* in FIG. 6 includes a primary coil 501, a secondary coil 502, and a switch 503. The ignition coil 104*a* turns on the switch 503 in response to an instruction from the control device 106*a* so as to energize the primary coil 501. Then, in response to an instruction from the control device 108*a*, the ignition coil 104*a* turns off the switch 503 so as to cut off the energization of the primary coil 501.

In this situation, a high voltage of, for example, 50 kV or lower is generated across the secondary coil 502. This high voltage is supplied to the central electrode 103*a* of the ignition plug 103, so that the voltage between the central electrode 103*a* and the GND electrode 103*b* becomes the same as or higher than the dielectric breakdown voltage. As a result, a spark discharge is formed between the central electrode 103*a* and the GND electrode 103*b*. Moreover, when supply of a high voltage the same as or higher than the discharge maintaining voltage to the central electrode 103*a* of the ignition plug 103 is continued, a spark discharge can continuously be formed. This spark discharge can ignite the fuel in the subsidiary combustion chamber 102.

Apart from the high voltage for a spark discharge, the smolder detector 105 generates a voltage of, for example, 20 V to 200 V for detecting a smolder. The smolder detector 105 can also generate a high voltage from a battery voltage, through a voltage-boosting DC/DC converter. The voltage for detecting a smolder may be generated by use of a general DC stabilized power source. However, in the present embodiment, for the purpose of reduction of the system cost, downsizing, and simplification, the smolder detector 105 provided with a power source device 504 is disposed inside the ignition coil 104*a*, as represented in FIGS. 3 and 6. In this situation, the ignition plug 103 is dealt with, as the one having the function of the detection probe 110.

In the power source device 504, a capacitor 501*a* is charged while the ignition coil 104*a* operates to generate a high voltage for a spark discharge. Then, after a spark discharge is completed, the voltage accumulated in the capacitor 501*a* is applied to the central electrode 103*a* of the ignition plug 103 that also plays the role of the detection probe 110. The configuration as described above makes it possible to realize a smolder detector that has a very small-size, low-cost, and simple configuration.

On the other hand, because mounted in the ignition coil, the capacitor 501*a* is restricted in terms of an electric capacity; therefore, in some cases, the value of the voltage accumulated in the capacitor 501*a* decreases while a voltage is applied to the central electrode 103*a*. In this case, it is desirable that immediately before a period where a smolder state is detected, the switch 503 is turned on and off in order to energize the ignition coil and then to cutoff the energization so that the capacitor 501*a* is charged. It may be allowed that the capacitor 501*a* is charged while a spark discharge occurs, as long as no problem is posed for the operation of the internal combustion engine 100 in the charging period. However, when a spark discharge actually occurs, the electrodes of the ignition plug are caused to be consumed. Therefore, it is desirable that the power source device 504 is charged in such a way that the switch 503 is turned on and off in a shortened period so that the ignition coil 104*a* is operated to the extent that no dielectric breakdown occurs.

Figure 4:
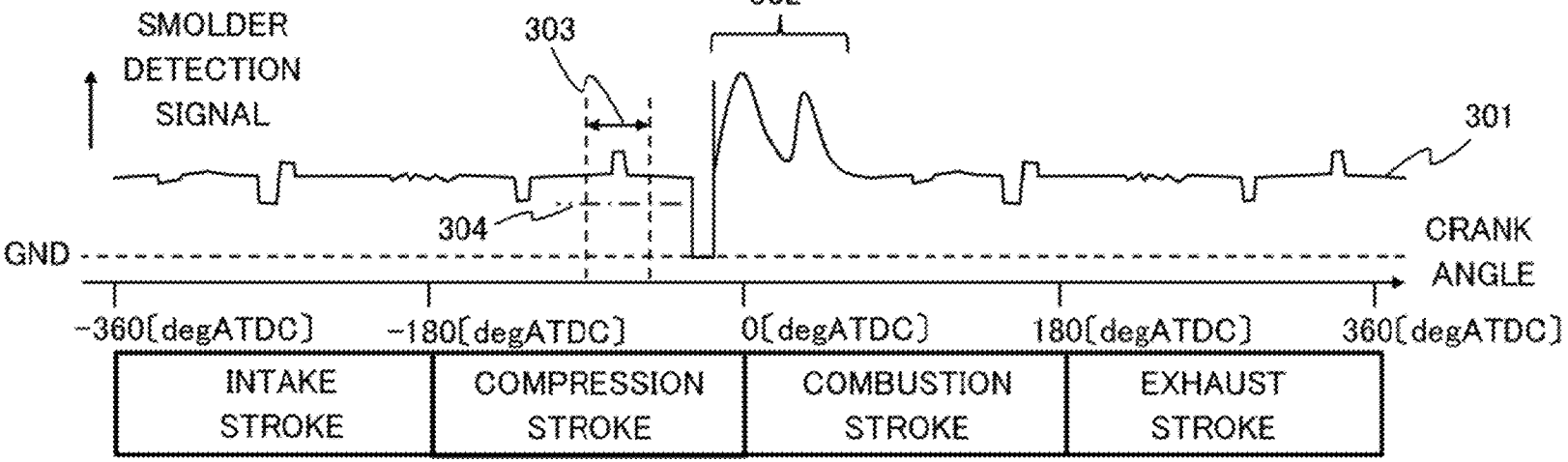
FIG. 4 is a first timing chart representing a smolder detection signal according to Embodiment 1.

There will be considered a state where a smolder occurs in the subsidiary combustion chamber 102 and reaches the ignition plug 103. In that state, application of a voltage to the central electrode 103*a* of the ignition plug 103 makes a current flow in accordance with the smolder state; then, the smolder detector 105 outputs a smolder detection signal 301, for example, as represented in FIG. 4. FIG. 4 is a first timing chart representing a smolder detection signal according to Embodiment 1; a state where a smolder has occurred is represented. The abscissa in FIG. 4 denotes a crank angle that indicates the progress of each of the strokes in a 4-cycle internal combustion engine 100. The respective numerals indicate the crank angles ranging up to +360 deg. and up to −360 deg. with respect to 0 deg., which is the crank angle of the top death center TDC in the compression stroke. "ATDC" signifies "after the top death center"; "deg." Signifies degrees. The ordinate denotes the smolder detection signal whose amplitude is indicated by a current value.

Figure 5:
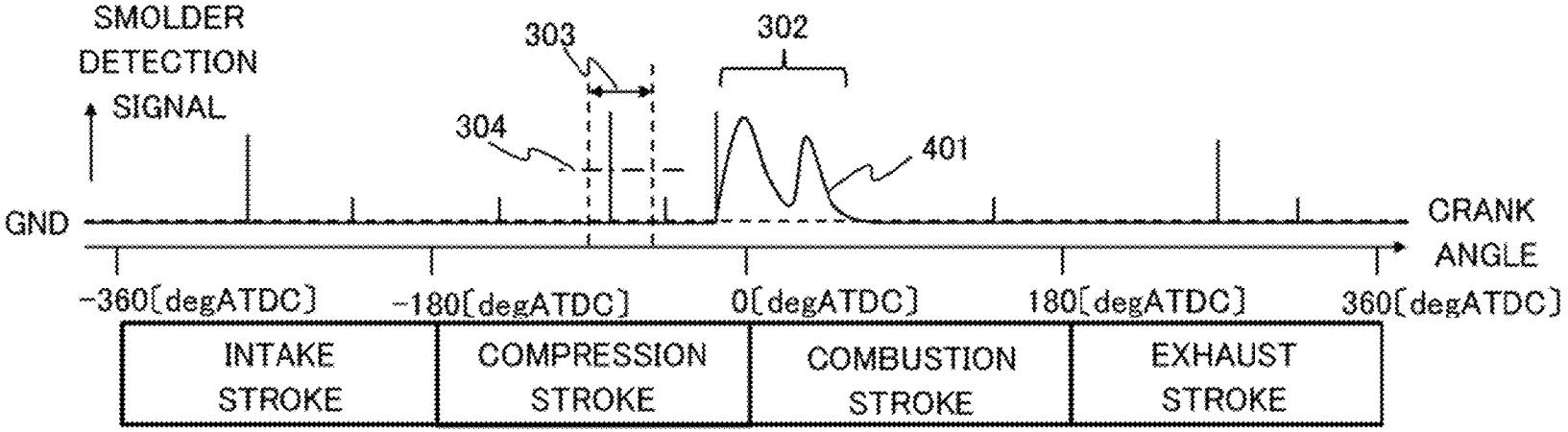
FIG. 5 is a second timing chart representing the smolder detection signal according to Embodiment 1.

The smolder detection signal in a normal combustion state where no smolder has occurred is represented as a smolder detection signal 401 in FIG. 5. FIG. 5 is a second timing chart representing a smolder detection signal according to Embodiment 1; a state where no smolder has occurred is represented. The respective definitions of the abscissa and the ordinate are the same as those in FIG. 4. In a section where no combustion and the like have occurred, the smolder detection signal 401 becomes a signal having a level the same as the GND (reference electric potential).

The above description can be applied to the case where the ignition coil 104*a* and the smolder detector 105 are separately provided and to the case where the ignition plug 103 and the detection probe 110 are separately provided. Also in each of the cases, the respective smolder detection signals represented in FIGS. 4 and 5 can be obtained; a smolder state can be diagnosed by the following same procedure.

The smolder diagnosis device 106 may be an independent unit equipped with a microcomputer. However, the smolder diagnosis device 106 can be configured as software in the microcomputer. In recent years, it is general that the control device 108*a*, which is an ECU (Electronic Control device), is configured in such a way as to be equipped with a microcomputer; therefore, the smolder diagnosis device 106 can be configured as software in the microcomputer of the control device 108*a*. As a result, the cost of the system can be reduced and the system can be simplified.

<Smolder Diagnosis>

The procedure with which the smolder diagnosis device 106 performs a smolder diagnosis will be explained.

In Embodiment 1, the smolder diagnosis is constantly performed from a time point when the internal combustion engine 100 starts to a time point when the internal combustion engine 100 stops. However, it may be allowed that in order to suppress the calculation load on the microcomputer, the diagnosis is performed only under a preliminarily instructed specific operation condition. For example, the diagnosis is performed when there are satisfied all of the conditions that the rotation speed of the internal combustion engine 100 is the same as or lower than 2000 [rev/min], that the throttle opening degree is the same as or smaller than 20%, and that the water temperature is lower than 80° C. or when at least one of the above conditions is satisfied. It may be allowed that the diagnosis is not performed under other conditions. This condition is the operation condition for the internal combustion engine 100 in which a smolder is liable to occur.

The smolder detection signal 301 in FIG. 4 is introduced into the microcomputer through the A/D converter. For example, the smolder detection signal 301 is introduced into the microcomputer at a resolution of 10 bits per degCA (1 deg. crank angle).

The smolder diagnosis device 106 sets a diagnosis section for diagnosing a smolder. In the method in which a smolder state is detected by applying a voltage to the detection probe 110 or the ignition plug 103, the smolder detector 105 is affected by ions produced due to combustion and may generate a signal such as an ion noise portion 302 in FIG. 4, regardless of whether or not a smolder exists. Accordingly, the diagnosis section is set in a section where no combustion occurs in the subsidiary combustion chamber 102 or in the main combustion chamber 107, for example, in a section from −360 [degATDC] to −50 [degATDC] or from 80 [degATDC] to 360 [degATDC].

The smolder diagnosis section may be set in a wide range such as being from −360 [degATDC] to −50 [degATDC] and from 80 [degATDC] to 360 [degATDC]. Alternatively, the smolder diagnosis section may be set in two or more short ranges such as being from −350 [degATDC] to −300 [degATDC], from −100 [degATDC] to −50 [degATDC], and from 100 [degATDC] to 150 [degATDC]. Moreover, the smolder diagnosis section may be set in a section starting 3 milliseconds before the timing at which the control device 108*a* issues an instruction to the ignition coil 104*a* so as to make the ignition coil 104*a* start energization of the primary coil.

The diagnosis section may be set for each operation condition. The diagnosis section may be set as table values and map values for the rotation speed of the internal combustion engine 100, the load on the internal combustion engine 100, the coolant temperature, and the like. For example, the mode that is determined as a starting state where the water temperature is lower than 80° C. is most susceptible to the effect of a smolder; thus, the smolder diagnosis section can be set in a wide range such as being from −360 [degATDC] to −50 [degATDC] and from 80 [degATDC] to 360 [degATDC].

An idling mode after the starting mode is still susceptible to the effect of a smolder; thus, the smolder diagnosis section can be set in consideration of a wide range by setting two or more sections, while the calculation load on the microcomputer is reduced by shortening each of the diagnosis sections such as being from −350 [degATDC] to −300 [degATDC], from −100 [degATDC] to −50 [degATDC], and from 100 [degATDC] to 150 [degATDC].

An operation mode other than these modes is less susceptible to the effect of a smolder; however, it may be allowed that in order to quickly grasp the symptom of a smolder, the smolder diagnosis section may be set in such a way that the section starting 3 ms before the timing at which the control device 108*a* issues an instruction to the ignition coil 104*a* is constantly monitored and diagnosed.

In Embodiment 1, as represented in FIG. 4, as a diagnosis section where a diagnosis can be performed simply and efficiently, the section from −90 [degATDC] to −60 [degATDC] has been set as a smolder diagnosis section 303.

The smolder diagnosis device 106 sets a comparison current 304; in the case where the smolder detection signal 301 in the diagnosis section 303 has occurred with a level larger than the comparison current 304, the smolder diagnosis device 106 determines that a smolder has occurred in the subsidiary combustion chamber 102.

The strength of a smolder can be expressed as an electric resistance value. In general, it is known that the stronger a smolder becomes, the smaller the electric resistance value at the portion formed by the smolder becomes. For example, when the voltage for smolder detection, generated by the power source device 504, is 100 V and the level of a smolder is 1 MΩ, a current signal of 100 μA is generated as the smolder detection signal.

When it is desired that in the case where a smolder has the smolder level of 10 MΩ or larger, it is diagnosed that a smolder state has occurred, the smolder diagnosis device 106 sets the comparison current to 10 μA; in the case where in the diagnosis section 303, the average value, i.e., the average level of the smolder detection signal 301 becomes the same as or larger than 10 μA, it is diagnosed that a smolder state has occurred in the subsidiary combustion chamber 102; then, for example, the diagnostic result level is set to "1". In the case where it is diagnosed that no smolder has occurred, the diagnostic result is set to "0".

A smoother of the smolder detector 105 may obtain the average level of the smolder detection signal 301. A comparison-value setter of the smolder detector 105 may obtain the comparison value for the smolder detection signal 301. As the method of obtaining the average level of a signal, there may be utilized a median filter, a moving average, or a so-called average value to be obtained by dividing the integration value of a signal in a section by the section. In this situation, without making the section (period) constant, the diagnostic result level can be obtained by comparing the integration value with a value obtained by multiplying the threshold value by the length of the integration period, in accordance with the length of the integration period and the integration value.

Alternatively, it may be allowed that the smolder level is stepwise diagnosed in accordance with the average level of the smolder detection signal in the detection section. The diagnostic result level may be outputted in a multistage manner, for example, in such a way that when the average level is lower than 10 μA, the diagnostic result level is "0", that when the average level is the same as or higher than 10 μA but lower than 20 μA, the diagnostic result level is "1", that when the average level is the same as or higher than 20 μA but lower than 50 μA, the diagnostic result level is "2", that when the average level is the same as or higher than 50 μA but lower than 100 μA, the diagnostic result level is "3", and that when the average level is the same as or higher than 100 μA, the diagnostic result level is "4". Alternatively, it may be allowed that the smolder level is outputted as a non-stage continuous numerical value to be derived by a mathematical expression.

The control device 108*a* reads the diagnostic result level; in the case where the diagnostic result level is "l" and hence it is diagnosed that a smolder has occurred, the control device 108*a* performs its control in a direction where the output energy of the ignition coil 104*a* is increased so that a spark discharge can securely be produced even when there exists a smolder. For example, in the case of such an ignition coil as represented in the ignition-coil basic function unit 104*b* in FIG. 6, the control device 108*a* performs its control in a direction where the energization duration for the primary coil 501 is lengthened.

The reason why a smolder causes a misfire to occur is that energy for a spark discharge, generated by the ignition coil 104*a*, leaks through a conductive path formed by the smolder and hence no spark discharge is formed or that even when a spark discharge is temporarily formed, no spark discharge having energy required to ignite a fuel is not formed thereafter.

When a current for generating a spark discharge is increased, a large voltage can be generated in a process where the current tries to pass through a resistance path. When this voltage exceeds the dielectric breakdown voltage, a spark discharge can be produced. After a spark discharge is formed, the energy leaks also through the smolder path; therefore, in order to securely ignite a fuel when a smolder exists, there is required the ignition coil 104*a* that can generate a large current and large energy in comparison with the performance of the ignition coil that is required in a normal state where no smolder exists.

However, when in a normal state where no smolder has occurred, there is maintained a spark discharge with an excessive current and excessive energy that are larger than a current and energy required for ignition, consumption of the ignition-plug electrodes is accelerated; moreover, due to the spark discharge, more NOx is produced. In particular, the automobile internal combustion engine 100, such as the subsidiary-chamber-type internal combustion engine according to according to Embodiment 1, that frequently utilizes lean operation may be caused to operate in a condition where a three-way catalyst does not function; thus, the occurrence amount of NOx is posed as a problem.

Accordingly, it is required that the ignition coil 104*a* can be utilized at a critical mass of its output in a normal state where no smolder has occurred and can raise its output as much as required, when it is diagnosed that a smolder has occurred.

As an example, the case where the ignition coil is the general one as represented in the ignition-coil basic function unit 104*b* in FIG. 6 will be explained in detail. As a voltage that can securely produce a spark discharge even when the smolder level is 0.3 MΩ, which is a maximum level possible to actually occur, 30 kV is anticipated.

In order to generate the 30 kV in a stage before energy flows into a smolder path, it is required that the ignition coil preliminarily outputs a current of 10 mA. When it is assumed that in a state where a smolder can be produced, the anticipated maximum stray electric capacitance in the ignition path is 30 pF, energy of 14 mJ is required to charge the capacitance up to 30 kV. Accordingly, it is required that the ignition coil has an ability that can output 100 mA at a time point when energy of 14 mJ has been consumed. Furthermore, it is required to consider the energy that leaks through a leak path during a spark discharge sustaining period after a dielectric breakdown.

When the foregoing conditions are considered with regard to the internal combustion engine 100 that requires an ignition-coil performance of 90 mJ for stably operating in a state where no smolder exists, the required ignition-coil ability for making the internal combustion engine 100 stably operate in a state where a smolder exists is as follows: i.e., the maximum output current is the same as or larger than 105 mA, and the output energy is the same as or larger than 95 mJ.

In the case where the output of the smolder diagnosis device 106 is binary, and, for example, in the case where in a state where a smolder exists, i.e., the diagnostic result level is "1" with an ignition coil whose maximum output current is the same as or larger than 105 mA from the foregoing assumption, the control device 108*a* issues an instruction to the ignition coil 104*a* so that the output thereof becomes 100%. In a state where no smolder exists, i.e., the diagnostic result level is "0", the control device 108*a* issues an instruction to the ignition coil 104*a* so that the output thereof becomes the same as or smaller than 95. Because it is assumed that in a state where no smolder has been detected, no smolder occurs, the control device 103*a* issues an instruction to the ignition coil 104*a* so that the output thereof becomes the same as or smaller than 95%.

In the case where the output of the smolder diagnosis device 106 has two or more level values, i.e., the output is multistage, it may be allowed that the control device 108*a* issues instructions, for example, so that when the diagnostic result level is 0, the output of the ignition coil becomes 95, so that when the diagnostic result level is 1, the output of the ignition coil becomes 96%, so that when the diagnostic result level is 2, the output of the ignition coil becomes 97%, so that when the diagnostic result level is 3, the output of the ignition coil becomes 96%, and so that when the diagnostic result level is 4, the output of the ignition coil becomes 1003.

In the case where when receiving a diagnostic result showing that a smolder has occurred, the foregoing diagnostic result is, for example, larger than 1, the control device 108*a* adjusts the injection amount and the injection timing of a fuel to be supplied into the main combustion chamber 107 or the subsidiary combustion chamber 102 so that the excess air rate λ in the subsidiary combustion chamber becomes substantially 0.9 through 1.0. The excess air rate λ=1.0 means a theoretical amount of air for the air-fuel mixture. The excess air rate λ>1.0 means an excessive amount of air for the air-fuel mixture, and is called "lean". The excess air rate λ<1.0 means an insufficient amount of air for the air-fuel mixture, and is called "rich". For example, in a state where lean operation with the excess air rate λ of substantially 2.0 is performed, the fuel injection amount is increased so that even with a weak spark discharge, stable ignition and combustion can be obtained. In a state where rich operation with the excess air rate λ of substantially 0.8 is performed, it is made possible that occurrence of a smolder is suppressed by decreasing the fuel injection amount. In this situation, it may be allowed that the throttle is concurrently adjusted, for example, to increase the charged air amount in the combustion chamber so that the changing amount of the output torque of the internal combustion engine 100 decreases. In some cases, when in the main combustion chamber 107, the injection timing of the fuel injector 109 is changed, the excess air rate of a fuel-air mixture entering the subsidiary combustion chamber 102 can be changed. Although the total excess air rate in the main combustion chamber 107 and the subsidiary combustion chamber 102 does not change, a change in the injection timing changes the excess air rate of a fuel-air mixture entering the subsidiary combustion chamber 102.

Accordingly, because Embodiment 1 makes it possible that a smolder state in the subsidiary combustion chamber is diagnosed and an appropriate treatment is performed, a subsidiary-chamber-type internal combustion engine capable of largely raising the thermal efficiency can stably be operated; thus, the exhaust amount of greenhouse effect gas is largely reduced, which contributes to environmental conservation. Moreover, Embodiment 1 contributes also to improvement of the reliability of the internal combustion engine 100.

2. Embodiment 2

Figure 7:
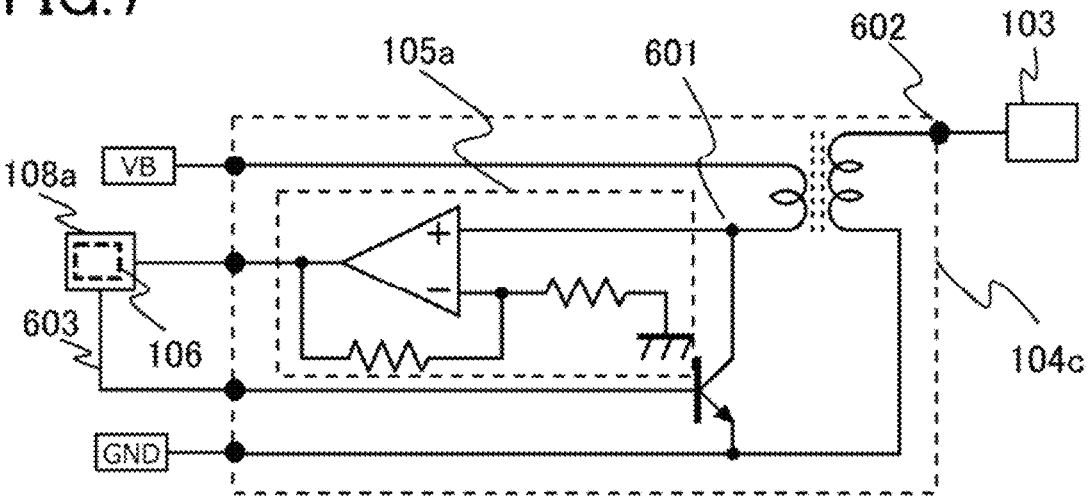
FIG. 7 is a circuit diagram of a smolder detector according to Embodiment 2.

In Embodiment 1, there is utilized a method in which a smolder is detected by applying a smolder-detection voltage, which is different from a spark-discharge high voltage, to the ignition plug; however, by use of such an apparatus as represented in FIG. 7, it can be diagnosed whether or not a smolder exists, based on the profile of a voltage at a time when a spark discharge is formed. FIG. 7 is a circuit diagram of the smolder detector 105*a* according to Embodiment 2. The smolder detector 105*a* is incorporated in the ignition coil 104*c*. Hereinafter, the procedure of a smolder diagnosis will be explained by use of FIGS. 7, 8, and 9.

In Embodiment 2, a voltage to be generated at a detection point 601 in FIG. 7 can be utilized as a smolder detection signal. As represented in FIG. 7, a smolder detector 105*a* can be configured at the primary side of the ignition coil 104*c*. However, the smolder detector 105*a* can directly be included in the smolder diagnosis device 106. Alternatively, it is also made possible to extract a smolder detection signal by use of a simple circuit such as a resistance voltage-dividing circuit. Still alternatively, although a special device is required, the circuit of the smolder detector 105*a* in FIG. 7 is connected with the secondary side of the ignition coil, for example, with a detection point 602, so that a similar smolder detection signal can be detected.

As is the case with Embodiment 1, through an A/D converter, the smolder detection signal is received by the smolder diagnosis device 106 configured as software in a microcomputer of the control device 108*a*.

Figure 8:
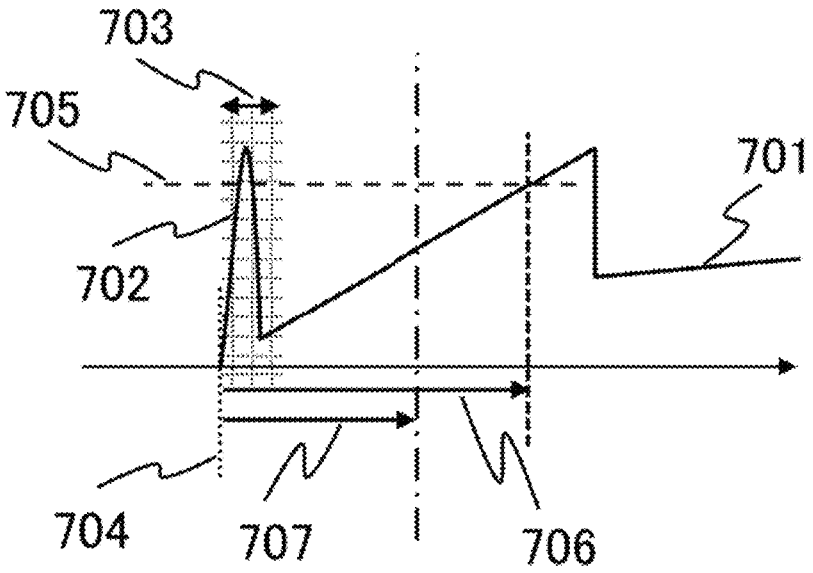
FIG. 8 is a first timing chart representing a smolder detection signal according to Embodiment 2.
Figure 9:
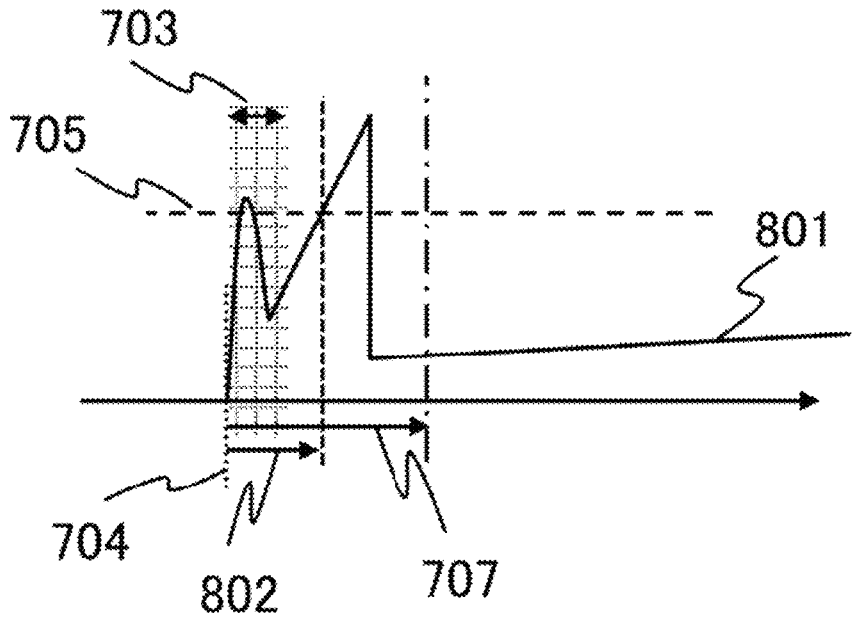
FIG. 9 is a second timing chart representing the smolder detection signal according to Embodiment 2.

The smolder detection signal at a time when a smolder exists becomes a smolder detection signal 701 in FIG. 8. FIG. 8 is a first timing chart representing a smolder detection signal according to Embodiment 2. The ordinate in FIG. P denotes the voltage. The abscissa in FIG. 8 denotes the time; the time can be replaced by the crank angle. The smolder detection signal at a time when no smolder exists becomes a smolder detection signal 301 in FIG. 9. FIG. 9 is a second timing chart representing a smolder detection signal according to Embodiment 2. The respective definitions of the ordinate and the abscissa are the same as those in FIG. 8. A noise component as expressed by noise 702 in FIG. 8 is superimposed on the smolder detection signal 801; therefore, in order to prevent an erroneous diagnosis, the smolder diagnosis device 106 masks the period where this noise occurs and neglects the smolder detection signal generated during this masking period 703.

Due to the operation of the ignition coil 104*c*, the voltage between the electrodes of the ignition plug 103 increases as the smolder detection signal 701 in FIG. 3 or the smolder detection signal 801 in FIG. 9 increases. In many cases, as the actual discharge voltage, a voltage that increases in a negative direction with respect to the GND is dealt with; however, in the present embodiment, for the sake of simplicity, the actual discharge voltage is regarded as an absolute value, and the direction in which the absolute value increases will be referred to as an increasing direction. The smolder diagnosis device 106 diagnoses whether or not a smolder has occurred, in accordance with the time in which the smolder detection signal 701, which is the foregoing voltage, reaches a predetermined value.

The timing at which the primary current of the ignition coil 104*c* is cut off, i.e., the timing at which a signal on an ignition coil control line 603 for the control device 108*a* to issue an instruction regarding the operation of the ignition coil 104*c* is turned from High to Low will be referred to as a reference time point 704.

A masking period setter of the smolder diagnosis device 106 sets the masking period 703 starting from the reference time point 704. The smolder diagnosis device 106 neglects the signal state during the masking period 703. The masking period 703 is substantially, for example, 2 μsec.

A comparison-voltage setter of the smolder diagnosis device 106 sets a comparison voltage 705 to be compared with the smolder detection signal. A period measure of the smolder diagnosis device 106 measures a time T from the reference time point 704 to a time point at which the smolder detection signal reaches the comparison voltage 705. The comparison voltage 705 is substantially, for example, 10 kV.

In addition, a comparison period setter of the smolder diagnosis device 106 sets a comparison time 707 to be compared with the time T. For example, the comparison time 707 is substantially 10 μsec. In the case where the time T is longer than the comparison time 707, the smolder diagnosis device 106 diagnoses that a smolder has occurred in the subsidiary combustion chamber 102 and then sets the diagnostic result level to 1. For example, the time T in which the smolder detection signal 701 at a time when a smolder has occurred reaches the comparison voltage 705 becomes a smolder determination index 706 and is longer than the comparison time 707; thus, it can be diagnosed that a smolder has occurred.

In the case where the time T is shorter than the comparison time 707, the smolder diagnosis device 106 diagnoses that no smolder has occurred in the subsidiary combustion chamber 102 and then sets the diagnostic result level to 0. For example, the time T in which the smolder detection signal 801 at a time when no smolder has occurred reaches the comparison voltage 705 becomes a smolder determination index 802 and is shorter than the comparison time 707; thus, it can be diagnosed that no smolder has occurred. In the present embodiment, the time is counted from the reference time point 704, which is the timing at which an instruction for turning the signal on the ignition coil control line 603 from High to Low; however, it may be also allowed that the time after the masking period 703 is counted.

As is the case with Embodiment 1, it may be allowed that the smolder level is stepwise diagnosed by providing two or more comparison times, for example, 10 μsec, 15 μsec, and 20 μsec.

In the case where the smolder diagnosis device 106 diagnoses that a smolder has occurred in the subsidiary combustion chamber 102, the control device 108*a*, as is the case with Embodiment 1, controls the ignition coil 104*c* and the fuel injector 109 and makes adjustment so that the internal combustion engine 100 can stably operate.

Accordingly, because although the smolder-level detection accuracy is lowered, Embodiment 2 makes it possible that a smolder state in the subsidiary combustion chamber is diagnosed and an appropriate treatment is performed with a simpler system configuration and at lower cost, a subsidiary-chamber-type internal combustion engine capable of largely raising the thermal efficiency can stably be operated; thus, the exhaust amount of greenhouse effect gas is largely reduced, which contributes to environmental conservation. Moreover, Embodiment 2 contributes also to improvement of the reliability of the internal combustion engine 100.

Although the present application is described above in terms of various exemplary embodiments and implementations, it should be understood that the various features, aspects and functions described in one or more of the individual embodiments are not limited in their applicability to the particular embodiment with which they are described, but instead can be applied, alone or in various combinations to one or more of the embodiments. Therefore, an infinite number of unexemplified variant examples are conceivable within the range of the technology disclosed in the present disclosure. For example, there are included the case where at least one constituent element is modified, added, or omitted and the case where at least one constituent element is extracted and then combined with constituent elements of other embodiments.

What is claimed is:

1. An internal-combustion-engine controller that controls an internal combustion engine provided with a main combustion chamber and a subsidiary combustion chamber for igniting a fuel-air mixture in the main combustion chamber with combustion gas to be injected through an orifice provided between the main combustion chamber and the subsidiary combustion chamber, the internal-combustion-engine controller comprising:

a fuel injector that injects a fuel into the main combustion chamber;

an ignition plug that is disposed in the subsidiary combustion chamber and generates a spark discharge between an electrode to which a high voltage is applied and a reference electrode so as to combust a fuel-air mixture;

an ignition coil that supplies a high voltage to the ignition plug;

a control device that controls the fuel injector and the ignition coil;

a detection probe that is disposed in the subsidiary combustion chamber;

a smolder detector that detects a smolder state caused by soot deposited on the ignition plug by use of the detection probe; and a smolder diagnosis device that diagnoses a smolder state in the subsidiary combustion chamber in accordance with a smolder detection signal from the smolder detector, wherein in accordance with a diagnostic result in the smolder diagnosis device, the control device controls operation of at least one of the ignition coil and the fuel injector.

2. The internal-combustion-engine controller according to claim 1, wherein the ignition plug plays also the role of the detection probe.

3. The internal-combustion-engine controller according to claim 2, wherein the smolder detector and the ignition coil are provided in one and the same package.

4. The internal-combustion-engine controller according to claim 1, wherein the smolder detector has a power source device that supplies a detection voltage for detecting a smolder, wherein the smolder diagnosis device includes a diagnosis-section setter that sets a diagnosis section for diagnosing a smolder, a smoother that smooths the smolder detection signal, and a comparison-value setter that sets a comparison value to be compared with the smolder detection signal that has been smoothed, and wherein in the case where the absolute value of the smolder detection signal that has been smoothed in the diagnosis section becomes larger than the comparison value, the smolder diagnosis device diagnoses that a smolder has occurred in the subsidiary combustion chamber.

5. The internal-combustion-engine controller according to claim 4, wherein the diagnosis-section setter sets, as the diagnosis section, a section in which no combustion occurs in the subsidiary combustion chamber.

6. The internal-combustion-engine controller according to claim 4, wherein the diagnosis-section setter changes the diagnosis section in accordance with an operation state of the internal combustion engine.

7. The internal-combustion-engine controller according to claim 6, wherein in the case where a cooling-water temperature of the internal combustion engine is lower than a predetermined determination water temperature and the internal combustion engine is in a starting state, the diagnosis-section setter sets a predetermined first diagnosis section, wherein in the case where the internal combustion engine is in an idling state, the diagnosis-section setter sets a second diagnosis section that is narrower than the first diagnosis section, and wherein in the case where the internal combustion engine is in another operation state, the diagnosis-section setter sets a third diagnosis section that is narrower than the second diagnosis section, at a time before the ignition coil has been energized.

8. The internal-combustion-engine controller according to claim 1, wherein the smolder detector outputs, as a smolder detection signal, information corresponding to a voltage for forming the spark discharge, wherein the smolder diagnosis device includes a masking period setter that sets a masking period for the smolder detection signal, a comparison voltage setter that sets a comparison voltage for the smolder detection signal, a period measure that measures a period in which after the masking period has elapsed, the smolder detection signal reaches the comparison voltage, and a comparison period setter that sets a comparison period to be compared with said period, wherein in the case where said period becomes longer than the comparison period, the smolder diagnosis device diagnoses that a smolder has occurred in the subsidiary combustion chamber.

9. The internal-combustion-engine controller according to claim 1, wherein in the case where the smolder diagnosis device diagnoses that a smolder has occurred in the subsidiary combustion chamber, the control device controls the ignition coil in a direction where output of the ignition coil increases.

10. The internal-combustion-engine controller according to claim 1, wherein in the case where the smolder diagnosis device diagnoses that a smolder has occurred in the subsidiary combustion chamber, the control device controls the ignition coil in a direction where output of the ignition coil increases, and wherein in the case where the smolder diagnosis device diagnoses that no smolder has occurred in the subsidiary combustion chamber or in the case where no smolder diagnosis has been performed, the control device controls the ignition coil in a direction where output of the ignition coil decreases.

11. The internal-combustion-engine controller according to claim 1, wherein the maximum value of an output current of the ignition coil is the same as or larger than 105 mA.

12. The internal-combustion-engine controller according to claim 1, wherein in the case where the smolder diagnosis device diagnoses that a smolder has occurred in the subsidiary combustion chamber, the control device controls at least one of an amount of fuel to be supplied by the fuel injector and a fuel injection timing.

13. The internal-combustion-engine controller according to claim 1, wherein in the case where the smolder diagnosis device diagnoses that a smolder has occurred in the subsidiary combustion chamber, the control device controls an amount of fuel to be supplied by the fuel injector so that an excess air rate in the subsidiary combustion chamber falls within a range from 0.9 through 1.0.

14. The internal-combustion-engine controller according to claim 1, wherein in the case where the smolder diagnosis device diagnoses that a smolder has occurred in the subsidiary combustion chamber, the control device controls a fuel injection timing of the fuel injector so that an excess air rate in the subsidiary combustion chamber falls within a range from 0.9 through 1.0.

15. The internal-combustion-engine controller according to claim 1, wherein the smolder diagnosis device and the control device are provided in one and the same package.

* * * * *